United States Patent [19]

Moon

[11] Patent Number: 4,549,543

[45] Date of Patent: Oct. 29, 1985

[54] AIR FILTERING FACE MASK

[76] Inventor: William F. Moon, P.O. Box 192, Buchanan, Mich. 49107

[21] Appl. No.: 446,045

[22] Filed: Dec. 1, 1982

[51] Int. Cl.[4] ..... A62B 7/10

[52] U.S. Cl. ..... 128/206.12; 128/206.15; 128/206.17; 128/206.28; 128/207.12

[58] Field of Search ..... 128/206.12, 206.15, 128/206.16, 206.17, 206.28, 203.29, 201.25, 206.13, 206.14, 206.21, 206.24, 201.25, 206.26, 207.11, 207.12, 205.27, 205.29, 206.18, 206.19, 206.22, 206.23, 206.27, 207.13

[56] References Cited

U.S. PATENT DOCUMENTS

| | | | |
|---|---|---|---|
| 1,948,945 | 2/1934 | Seigo | 128/206.12 |
| 2,153,437 | 4/1939 | Schwartz | 128/206.17 |
| 2,220,374 | 11/1940 | Lewis | 128/206.15 |
| 2,591,953 | 4/1952 | MacLean | 128/206.16 |
| 2,665,686 | 1/1954 | Wood et al. | 128/206.12 |
| 2,740,400 | 4/1956 | Wines | 128/206.17 |
| 2,894,508 | 7/1959 | Miles et al. | 128/206.17 |
| 2,895,472 | 7/1959 | Matheson | 128/206.15 |
| 3,042,035 | 7/1962 | Coanda | 128/206.24 |
| 4,328,797 | 5/1982 | Rollins, III et al. | 128/206.24 |

FOREIGN PATENT DOCUMENTS

| | | | |
|---|---|---|---|
| 591665 | 1/1934 | Fed. Rep. of Germany | 128/206.17 |
| 900416 | 7/1949 | Fed. Rep. of Germany | 128/206.15 |
| 746196 | 3/1933 | France | 128/201.25 |
| 763363 | 2/1934 | France | 128/206.15 |
| 35762 | 1/1953 | Poland | 128/206.17 |
| 195479 | 4/1938 | Switzerland | 128/206.15 |
| 504827 | 4/1939 | United Kingdom | 128/206.15 |
| 530285 | 12/1946 | United Kingdom | 128/206.17 |

*Primary Examiner*—Henry J. Recla
*Assistant Examiner*—Karin N. Reichle
*Attorney, Agent, or Firm*—Oltsch, Knoblock & Hall

[57] ABSTRACT

A respirator with an improved exhaust valve and a flexible face piece which conforms to the shape of the face of the wearer. The respirator is compact and principally formed of transparent material to minimize attention to the wearer.

4 Claims, 5 Drawing Figures

Fig. 1
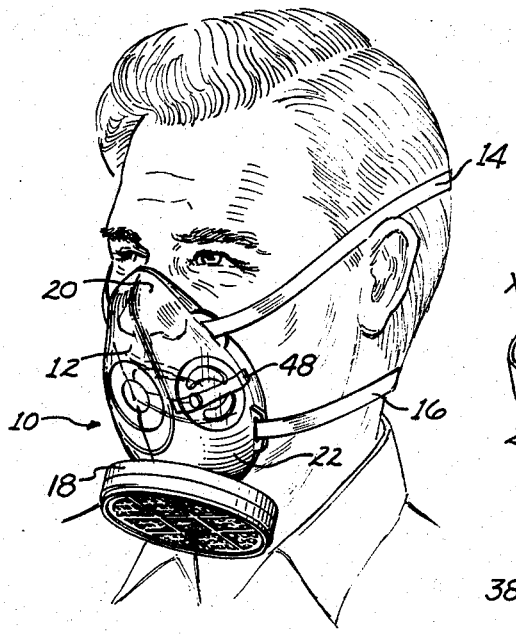
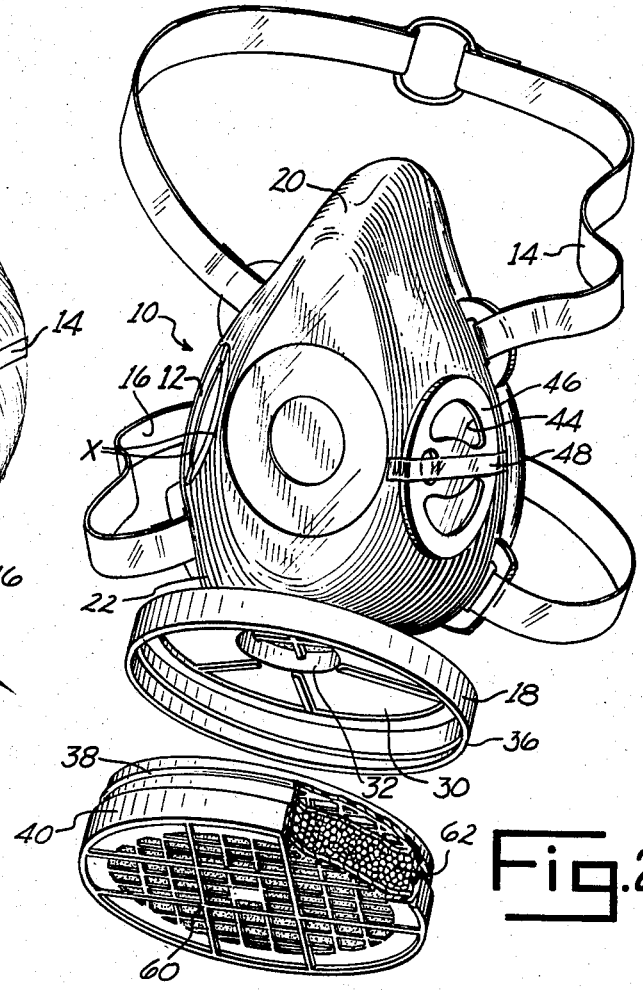
Fig. 2
Fig. 3
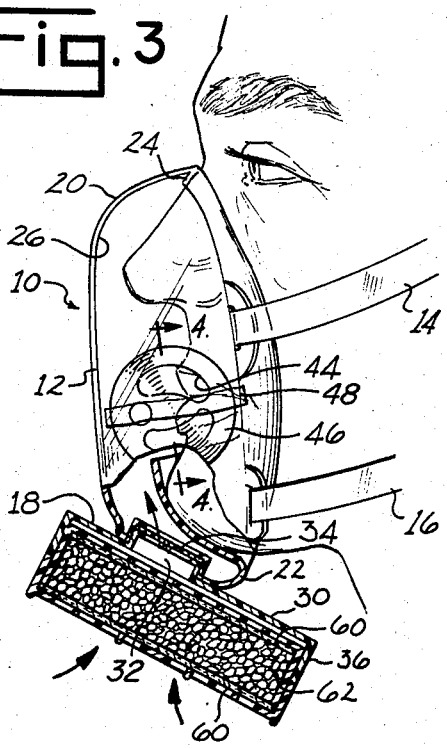
Fig. 4
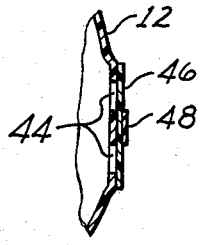
Fig. 5
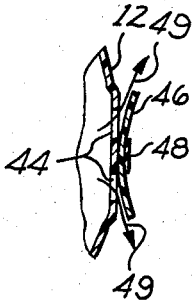

AIR FILTERING FACE MASK

SUMMARY OF THE INVENTION

This invention relates to a respirator and which has an improved exhaust valve and has minimal cosmetic objections by wearers.

Respirators are commonly used by persons who experience breathing difficulties. They serve to filter out harmful contaminants present in the atmosphere to allow a user to breathe freely and to lessen the strain that the contaminants might place on the person's lungs.

Previous respirators were often bulky devices which were unattractive and highly noticeable to passersby. Some prior art respirators are disclosed in U.S. Pat. Nos. 2,744,525; 2,898,908; 2,910,979; 1,931,989; 2,922,418; and 3,118,445.

The respirator of this invention is provided with a face piece or mask constructed of transparent material so that the device has minimum attention properties and is comfortable to wear. The face piece of the respirator is flexible and conforms to the face shape of the wearer, and is equipped with a small filter located under the user's chin when the respirator is worn so as to attract little attention thereto. The anchorage means and the exhaust valves are also constructed of transparent material to attract minimum attention.

The exhaust valve system of the respirator involves a thin flexible member spanning and normally closing an outlet opening in the respirator face piece and so secured to the face piece that, as a user exhales, air pressure inside the face piece flexes the plate outwardly to permit expulsion of exhaled gases from the face piece efficiently and safely.

Accordingly, it is an object of the invention to provide a respirator which efficiently allows a user's breath exhalations to escape from the respirator.

Another object is to provide for a respirator whose principal parts are transparent to minimize attention of bypassers to the wearer.

Another object is to provide for a respirator which is inconspicuous and economical.

Other objects will become apparent upon a reading of the following description.

BRIEF DESCRIPTION OF THE DRAWINGS

A preferred embodiment has been selected to illustrate the principles of the invention wherein:

FIG. 1 is a perspective view of a respirator as worn by a user.

FIG. 2 is a perspective view of a respirator showing the filter component detached from the face piece, portions thereof being depicted in cross-section.

FIG. 3 is a side view of the respirator being worn by a user, portions being shown in section.

FIG. 4 is a fragmentary cross-sectional view of the exhaust valve of the respirator shown in its closed position.

FIG. 5 is a fragmentary cross-sectional view of the exhaust valve of the respirator shown in its open position.

DESCRIPTION OF THE PREFERRED EMBODIMENT

The preferred embodiment herein described is not intended to be exhaustive or to limit the invention to the precise form disclosed. It is chosen and described to best explain the principles of the invention and their application and practical use to thereby enable others skilled in the art to utilize the invention.

The respirator of this invention, represented generally by numeral 10 in the drawings, includes a face piece or mask 12, a harness consisting of upper strap 14 and lower strap 16, and a filter cartridge holder 18. Face piece 12 includes a portion 20 which fits over the nose, and a portion 22 fitting under the chin of the user. The general contour of face piece 12 preferably includes internal marginal flanges 24 for contact with the face of the user. When worn, the face piece defines a substantially sealed chamber 26 in front of the nose and mouth of the wearer. Face piece 12 is preferably molded of flexible transparent material, such as polyvinyl chloride whereby the respirator 10 is minimally conspicuous when worn in public places. Straps 14 and 16 are formed of flexible transparent material such as thin polyethylene, are anchored to face piece 12, and are adjustable to secure the face piece in place upon the head of the user. Face piece 12 also has one or more pairs of spaced exhaust openings 44 formed therein. Each opening 44 is spanned by a thin flexible transparent member 46 preferably formed of plastic sheet material such as polyethylene or polyvinyl chloride. Each member 46 may be secured to face piece 12 by a strap 48, which extends across the central portion of member 46 between the pairs of openings 44 spanned by member 46 and is adhered or otherwise secured at both ends thereof to the face piece adjacent to members 46, as shown in FIG. 2. The function of member 46 is shown in FIGS. 4 and 5. Member 46 is normally positioned to span and close the adjacent openings 44, and when the user inhales, member 46 remains in its normally closed position shown in FIG. 4. As the user exhales, the air pressure increases inside chamber 26 and deflects portions of member 46 outwardly, allowing the breath exhaust to escape through exhaust openings 44 in the manner shown by arrows 48.

Cartridge holder 18 includes a rigid disc 30 anchored to the face piece around an opening 32 in portion 22 of the face piece 12. Opening 32 is spanned by a flexible disc 34, which acts as a check valve, permitting free entry of air into chamber 26 but preventing exhaust of air from chamber 26 through opening 32. Cartridge holder 18 is preferably located beneath portion 22 in substantially horizontal position as the face piece is worn, so as to minimize visual perception thereof. Disc 30 includes a cylindrical rim portion 36 which is provided with an internal thread into which an externally screw-threaded end portion 38 of a cartridge 40 is releasably anchored. Cartridge 40 preferably has a cylindrical body spanned at its opposite ends by reticulated walls 60 and encloses therein a porous body 62 of activated charcoal or other material to absorb harmful vapors such as sulphur dioxide, ozone, nitrous oxides, organic vapors and particulates.

Respirator 10 efficiently allows the user to inhale clean filtered air and exhale it for discharge from the respirator. The respirator is of light weight, is easily secured to the head of a wearer, and is inconspicuous when worn due to its transparent nature, its transparent exhaust valve, and the position, small size and location of cartridge 40.

It is to be understood that the above description does not limit the invention which may be modified within the scope of the appended claims.

I claim:

1. In a respirator including a face piece for positioning about the face of a user in marginal edgewise contact with the face of the user, said face piece defining a cavity into which air may be drawn, said face piece having an intake opening formed therein, a filtering means secured to said face piece at said intake opening for purifying air as it is drawn into said cavity, harness means for securing said face piece in said marginal contact position upon the face of a user, and exhaust means positioned on said face piece for allowing the expulsion of waste gases from said cavity, the improvement wherein said face piece and harness means are formed of flexible transparent material, said filtering means being located under the lower portion of said face piece in substantially horizontal position when worn for minimizing visual appearance as the respirator is worn so as to enhance the cosmetic value of the respirator, said exhaust means being located above and spaced from said filtering means, said exhaust means comprising two spaced adjacent exhaust openings and a flexible transparent sheet valve member overlying said exhaust openings and being anchored to the exterior of said face piece at the portion thereof between said adjacent exhaust openings, said valve member spanning said adjacent exhaust openings upon inhalation by said user and flexing to an open position upon exhalation, and a transparent retainer strap having two opposite ends is anchored to said face piece at said ends overlying and spanning the portions of said sheet valve member and said face piece between said adjacent openings.

2. The respirator of claim 1 wherein said filtering means is a cartridge releasably secured to said face piece around said intake opening.

3. The respirator of claim 1, wherein said harness means is adjustable to conform the margin of the face piece to the contour of the face of a user.

4. The respirator of claim 1, and a flexible sheet check valve secured to said face piece and spanning said intake opening interiorly of said filtering means, said last named sheet valve flexing to open position upon inhalation by a user and assuming closed position upon exhalation by a user.

* * * * *